US007199524B2

(12) United States Patent
Brady et al.

(10) Patent No.: US 7,199,524 B2
(45) Date of Patent: Apr. 3, 2007

(54) MAGNETRON ARRANGEMENTS

(75) Inventors: Michael Barry Clive Brady, Maldon (GB); Geoffrey Robert Dodd, Halstead (GB); Martin Bernard Edwards, Chelmsford (GB); Bernard Richard Mulcahy, Chelmsford (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 0 days.

(21) Appl. No.: 10/507,746

(22) PCT Filed: Mar. 17, 2003

(86) PCT No.: PCT/GB03/01106

§ 371 (c)(1),
(2), (4) Date: Sep. 16, 2005

(87) PCT Pub. No.: WO03/079393

PCT Pub. Date: Sep. 25, 2003

(65) Prior Publication Data

US 2006/0163060 A1 Jul. 27, 2006

(30) Foreign Application Priority Data

Mar. 16, 2002 (GB) ..... 0206240.4

(51) Int. Cl.
*H01J 23/46* (2006.01)

(52) U.S. Cl. ..... 315/39.51; 315/39.53; 315/39.67

(58) Field of Classification Search ..... 315/39.51, 315/39.53, 39.67
See application file for complete search history.

(56) References Cited

U.S. PATENT DOCUMENTS

| | | | | |
|---|---|---|---|---|
| 3,334,268 | A | 8/1967 | Edward | |
| 5,552,672 | A | 9/1996 | Rosenberg | |
| 5,886,473 | A * | 3/1999 | Watanabe et al. | 315/111.21 |
| 6,384,537 | B2 * | 5/2002 | Whyman | 315/39.53 |

FOREIGN PATENT DOCUMENTS

| | | |
|---|---|---|
| EP | 0 225 308 A | 6/1987 |
| EP | 0 427 482 A | 5/1991 |
| GB | 2 261 319 A | 5/1993 |
| GB | 2 310 533 A | 8/1997 |
| GB | 2 354 635 A | 3/2001 |
| GB | 2 357 630 A | 6/2001 |
| JP | 01 045043 A | 2/1989 |
| JP | 2001 229840 A | 8/2001 |
| WO | 01 46985 A | 6/2001 |

* cited by examiner

*Primary Examiner*—David Vu
(74) *Attorney, Agent, or Firm*—Venable LLP; Robert Kinberg

(57) ABSTRACT

A magnetron output arrangement includes a coaxial output adapted to be coupled in an endfire configuration to a rectangular waveguide. The waveguide has a flange for mating with the magnetron output arrangement. The coaxial output includes a central conductor. The output arrangement further includes a plate located in a predetermined position with respect to the central conductor. The plane of the plate is arranged to be substantially perpendicular to the axis of the coaxial output. The plate is located a predetermined distance from the end of the central conductor, such that the coaxial output in use couples with the plate so that the output coupling is substantially the same regardless of the type of waveguide flange employed.

5 Claims, 3 Drawing Sheets

MAGNETRON ARRANGEMENTS

This invention relates to magnetron arrangements and more particularly to magnetron outputs.

In recent years there has been a drive towards more compact magnetron arrangements, giving weight savings and a reduction in materials required. Our co-pending British patent application no 9930110.3 discloses a magnetron having a coaxial output coupled in an endfire configuration to a rectangular waveguide. The present invention arose as a development of this magnetron arrangement.

The invention provides a magnetron output arrangement comprising a coaxial output including a central conductor, the output further comprising a plate located in a predetermined position with respect to the central conductor.

The provision of a plate in a fixed position with respect to the central conductor improves coupling, in use, between the magnetron and a waveguide.

In the aforementioned patent application, it was identified that coupling was improved by arranging for the central conductor to be approximately aligned with the edge of a wall of the waveguide. However, the inventors discovered that this benefit was heavily dependent upon the spacing between the end of the probe and the waveguide, so that coupling was variable, depending on the type of flange included at the end of the waveguide. The invention simulates a waveguide wall at a predetermined distance from the probe, so that the output coupling is substantially the same, regardless of the type of waveguide flange employed.

The invention further provides a magnetron arrangement comprising a magnetron having a coaxial output including a central conductor, and further comprising a plate located in a predetermined position with respect to the central conductor.

Figure 1:
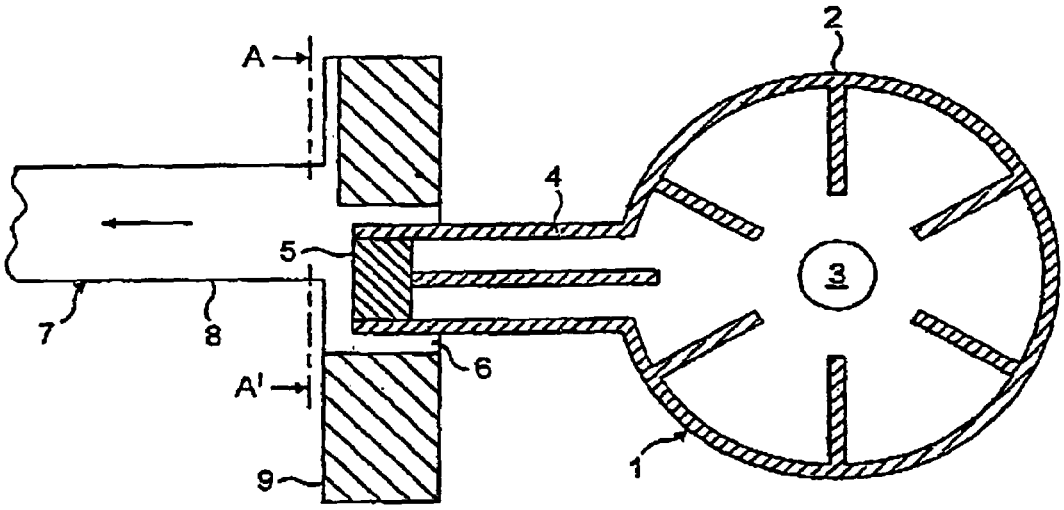
FIG. 1 (PRIOR ART)
Figure 2:
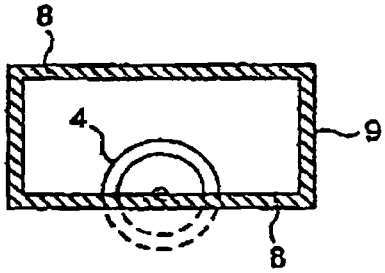
FIG. 2 (PRIOR ART)
Figure 3:
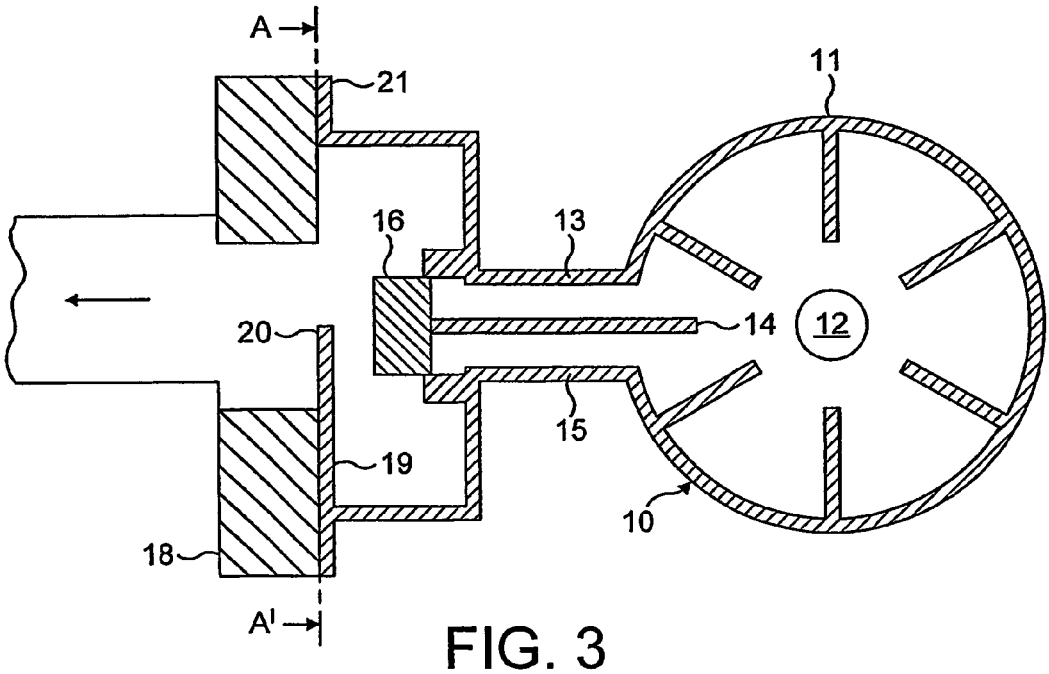
Figure 4:
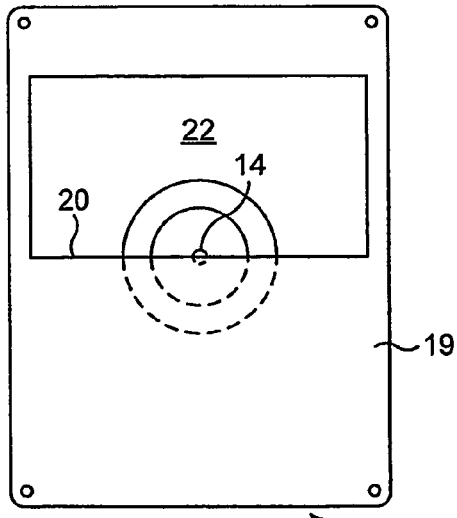
Figure 5:
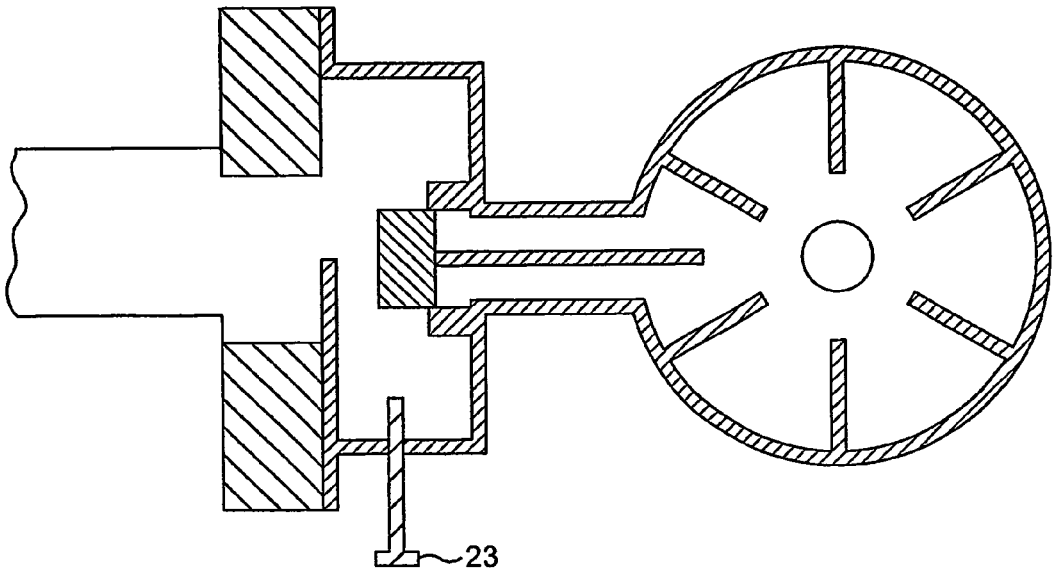

The invention will now be described, by way of example, with reference to the accompanying drawings in which:

FIG. 1 schematically shows a sectional plan view of a prior art magnetron and waveguide arrangement;

FIG. 2 schematically shows the arrangement of FIG. 1 along the line A—A;

FIG. 3 shows a sectional plan view of a magnetron including an output arrangement constructed in accordance with the invention;

FIG. 4 schematically shows the arrangement of FIG. 3 along the line B—B; and FIG. 5 schematically shows a sectional plan view a magnetron including an alternative output arrangement constructed in accordance with the invention.

With reference to FIGS. 1 and 2, the prior art magnetron arrangement typically comprises a magnetron 1 having anode 2 surrounding a central cathode 3. Power is extracted from the magnetron 1 in a conventional manner and is transmitted along a coaxial output line 4. The end of the coaxial output line 4 terminates in a probe 5, which extends through an opening 6 in an end of a rectangular waveguide 7.

As can be seen in FIG. 1, the coaxial output 4 is coupled in an endfire configuration to the end of the rectangular waveguide 7. By "endfire configuration" it is meant that the coaxial output 4 extends in the same direction as the direction in which energy is transmitted along the waveguide 7, which direction is shown in FIG. 1 by the arrow. As can be seen more clearly in FIG. 2, the coaxial output line 4 is aligned relative to the-waveguide 7 such that it is approximately in line with the edge of one of the broad walls 8 of the waveguide and at the mid point of that wall.

A problem which may be encountered with this type of magnetron arrangement is that the coupling between the magnetron and the waveguide is not always the same, and seems to vary in dependence on the type of mating flange 9 located at the end of the waveguide.

A magnetron including an output arrangement constructed in accordance with the invention is shown in FIG. 3. This drawing shows a magnetron 10 having an anode 11 surrounding a central cathode 12. Power is extracted from the magnetron via a loop and is transmitted along a coaxial output line 13, as before. The coaxial line comprises a central conductor 14 and an outer conductor 15. The end of the coaxial output line 13 terminates in a probe 16. Power is transmitted to a waveguide 17 arranged in an end-fire configuration. The waveguide terminates in a flange 18.

The inventors realised that the distance between the end of the probe 16 and the broad wall of the rectangular waveguide 17 influenced the degree of coupling into the waveguide, hence the coupling efficiency was dependent upon the type of flange employed.

In accordance with the invention, the magnetron output arrangement includes a plate member 19, located in a predetermined position with respect to the end of the central conductor 14 of the coaxial output line 13. Preferably, an edge 20 of the plate member is arranged to overlap approximately half of the probe in a spaced relationship, so that the plate member simulates the effect of the broad wall of a rectangular waveguide. As can be seen in FIG. 4, the plate member 19 effectively bisects the end of the probe as seen from the waveguide. Thus, the benefits of the prior art "end-fire" arrangement are retained, but the coupling is optimised because the distance between the end of the probe and the plate member is fixed.

A further advantage of the invention is that the base 21 of this magnetron output arrangement is capable of mating with any type of waveguide flange.

The base 21 includes a rectangular aperture 22, one broad edge of which is formed by the edge 20 of the plate member 19. This aperture need not be rectangular: for example, it could be semicircular (with the base of the semicircle comprising the edge 20 of the plate 19), elliptical or square.

An alternative magnetron output arrangement is shown in FIG. 5. This output arrangement has the same features as the output of FIGS. 3 and 4, but also has a tuning stub 23. The stub permits the output of the magnetron to be tuned according to the mode of operation of the magnetron.

The output arrangement maybe integral with the magnetron or may be a separate item. The output arrangement may be hermetically sealed.

The invention claimed is:

1. A magnetron output arrangement comprising a coaxial output adapted to be coupled in an endfire configuration to a rectangular waveguide, the waveguide having a flange for mating with the magnetron output arrangement, the coaxial output including a central conductor, and the output arrangement further comprising a plate located in a predetermined position with respect to the central conductor, the plane of the plate being arranged to be substantially perpendicular to the axis of the coaxial output, and the plate being located a predetermined distance from the end of the central conductor, such that the coaxial output in use couples with the plate so that the output coupling is substantially the same regardless of the type of waveguide flange employed.

2. A magnetron output arrangement as claimed in claim 1, wherein the plate has an edge arranged to overlap the end of the central conductor by a predetermined amount.

3. A magnetron output arrangement as claimed in claim 2, wherein the edge of the plate is arranged to overlap substantially half of the end of the central conductor.

4. A magnetron output arrangement as claimed in claim 1, further comprising tuning means.

5. A magnetron including an output arrangement as claimed in claim 1.

* * * * *